US006539949B2

(12) United States Patent
Christensen

(10) Patent No.: US 6,539,949 B2
(45) Date of Patent: Apr. 1, 2003

(54) APPLICATOR FOR APPLYING LIQUIDS TO HAIR-COVERED SKIN

(76) Inventor: Peter N. Christensen, 974 Chesney Land, Bel Air, MD (US) 21014-2628

( * ) Notice: Subject to any disclaimer, the term of this patent is extended or adjusted under 35 U.S.C. 154(b) by 0 days.

(21) Appl. No.: 09/820,545

(22) Filed: Mar. 29, 2001

(65) Prior Publication Data

US 2002/0139383 A1 Oct. 3, 2002

(51) Int. Cl.[7] ..... A45D 24/22
(52) U.S. Cl. ..... 132/114; 132/112; 132/116
(58) Field of Search ..... 132/114, 112, 132/113, 115, 116, 208, 207

(56) References Cited

U.S. PATENT DOCUMENTS 678,004 A * 7/1901 Myers ..... 132/114
3,477,447 A * 11/1969 Eldredge ..... 132/114
3,861,407 A * 1/1975 Gabriele ..... 132/114
4,457,642 A * 7/1984 Braithwaite et al. ..... 401/188
D314,840 S * 2/1991 Graley ..... D28/10
5,311,887 A * 5/1994 Ramsey ..... 132/114
5,339,839 A * 8/1994 Forcelledo et al. ..... 132/114
5,555,899 A * 9/1996 Foreman ..... 132/114
6,260,557 B1 * 7/2001 Yarbrough ..... 132/208

* cited by examiner

*Primary Examiner*—John J. Wilson
*Assistant Examiner*—Robyn Kieu Doan
(74) *Attorney, Agent, or Firm*—Roland H. Shubert

(57) ABSTRACT

A device for applying a thin, even layer of a liquid medicament to the scalp or other hair-covered skin surface while minimizing the amount of liquid wetting the hair is disclosed. The device includes a liquid reservoir and an applicator body having at least one downwardly extending tooth, each tooth having an internal fluid channel in communication with the reservoir, and having orifice ports adjacent to but above the tooth end. Metered doses of liquid are delivered to the orifice ports by operation of a manually operated pump or other fluid transport means.

9 Claims, 2 Drawing Sheets

APPLICATOR FOR APPLYING LIQUIDS TO HAIR-COVERED SKIN

BACKGROUND OF THE INVENTION

1. Technical Field

This invention relates to an applicator for applying liquids to hair-covered skin such as the skin of the scalp.

More specifically, this invention relates to a method for applying a pharmacologically active liquid to a hair-covered skin surface with minimal wetting of the hair.

2. Description of Related Art

It is common to treat a scalp condition by the application of a liquid medicament to the skin of the scalp. One example of such a treatment is the application of a dilute minoxidil topical solution to the scalp for the purpose of stimulating new hair growth. The minoxidil solution is usually applied twice a day, once in the morning after the hair has been washed and dried and a second time an hour or two before retiring.

Application of the minoxidil solution to the scalp is typically accomplished in one of two ways. A sprayer may be used if the area of the scalp being treated either lacks hair or displays a sparse growth of hair. A spray application is not satisfactory when a more extensive growth of hair is present because the hair is thoroughly wetted as well. In that circumstance, the minoxidil solution is applied using a dropper to apply a few drops of the solution directly upon the skin of the scalp. The liquid is then rubbed into the scalp, the dropper is moved over to an untreated area, and the process is repeated until coverage of the scalp is complete.

A number of different devices for applying liquids to the body of a human or animal are also disclosed in the prior art. For example, Johnson et al in their U.S. Pat. No. 5,088,849 disclose an applicator for applying simultaneously at least two different liquids to the skin of a human. The applicator includes a handle having at least two separate reservoirs which are in fluid communication with a permeable applicator pad. A pair of hand-actuated pumps are mounted upon the handle and are arranged to force a stream of liquid from each reservoir into the applicator pad.

Another such device is described in U.S. Pat. No. 4,608,045 to Fretwell. The applicator shown in the patent includes a liquid permeable base pad for impressing brands or medicaments to an animal. A pump mechanism is contained within the handle, and pressure applied against the handle forces a quantity of liquid through the base pad.

While a variety of different applicators and application techniques for applying liquids to humans and animals have been developed, none of the applicators known in the prior art have the capability for applying a liquid to a hair-covered skin surface while at the same time avoiding any substantial wetting of the hair. This invention has that capability.

SUMMARY OF THE INVENTION

This invention provides an applicator device and a method for applying a liquid medicament directly onto a hair-covered skin surface, and particularly onto the hair-covered scalp of a human. The device includes one or more teeth or tines, each having a central conduit connecting an orifice located adjacent the free tooth end to a liquid reservoir. A pump or other pressurizing means is arranged to deliver metered doses of the liquid through the conduit and out of the orifice directly onto the skin surface without significant wetting of the hair.

It is therefore an object of this invention to provide a device for applying a liquid to a hair-covered skin surface.

Another object of this invention is to provide a method for applying a liquid medicament to the skin of the scalp without significant wetting of the hair.

Other objects will become apparent from the following description of preferred embodiments of the invention.

DESCRIPTION OF PREFERRED EMBODIMENTS OF THE INVENTION

Figure 1:
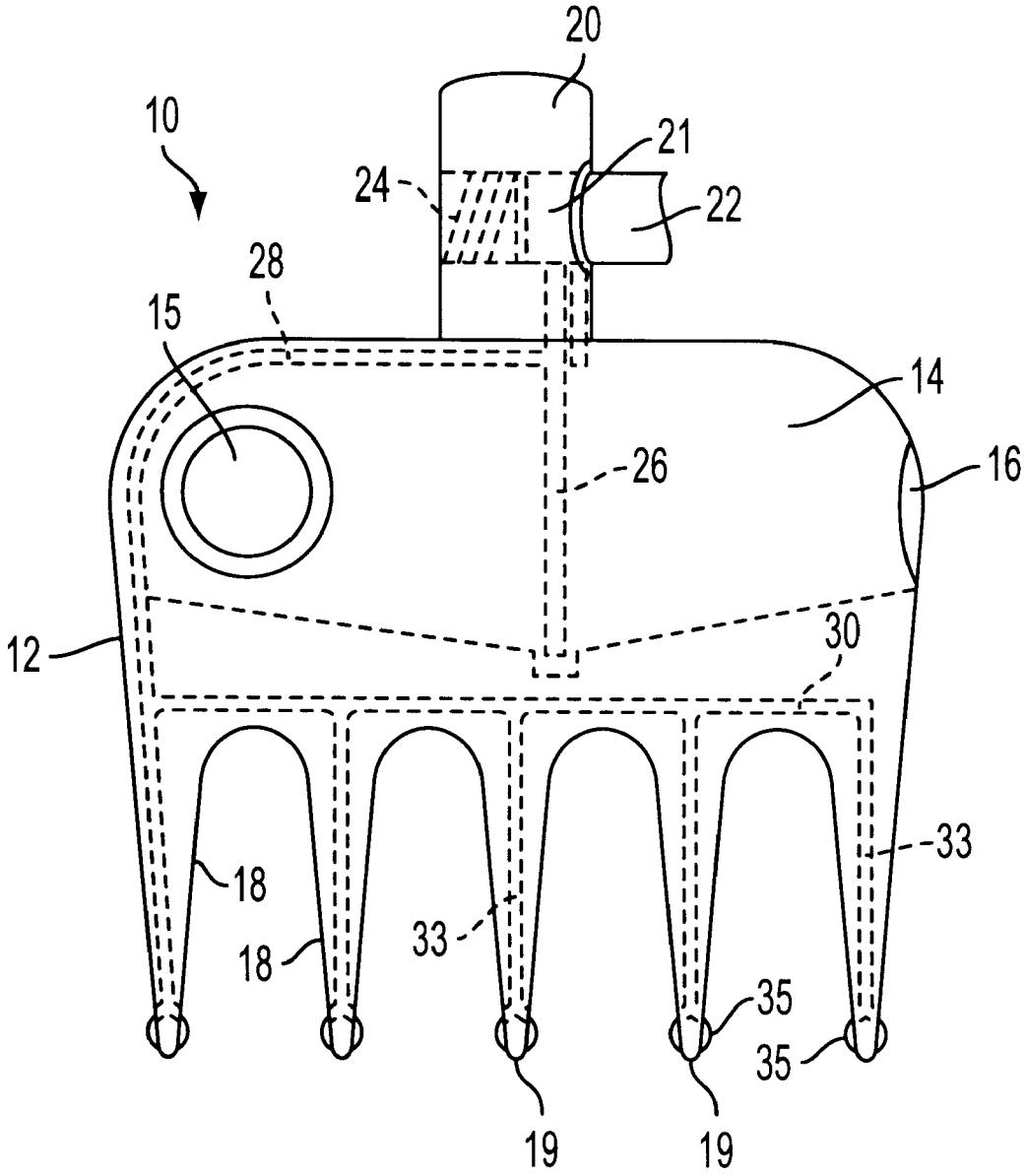
FIG. 1 is a partial sectional view of a unitary applicator constructed in accordance with this invention.

FIG. 1 depicts a first, unitary embodiment of the applicator means of this invention and is shown generally at 10. Applicator 10 includes a body member 12 of a size and shape to be comfortably held in one hand. The body member is hollow and forms a reservoir 14 to hold a liquid medicament that may be loaded into the reservoir through capped port 15. A window 16 may also be provided in one side of the reservoir body to allow a visual gauge of the liquid level within the reservoir. At least one tooth, and preferably a plurality of teeth 18, which may be arranged in rows and columns in the manner shown in FIG. 4 extend downwardly from the body member 12 to terminate at tooth tip 19.

A hand-actuated pump 20 is mounted atop reservoir 14. Pump 20 includes a piston member 21 that is operated by means of plunger 22 working against spring 24. A suction tube 26 extends from the pump to a lower region of reservoir 14 to supply liquid medicament to the pump. A second conduit 28 connects the discharge port of pump 20 to a manifold 30.

Figure 2:
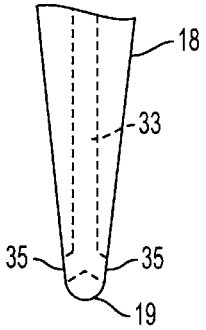
FIG. 2 is a detail view of a single tooth or tine.

Referring now to FIG. 2 as well as to FIG. 1, each tooth 18 is provided with a longitudinally extending channel 33 connecting at its upper end to manifold 30 and terminating in port means that comprise one or more orifices 35 that are positioned just above the tooth tip or end 19. It is important to the effective functioning of applicator 10 that orifices 35 not become clogged or blocked. Consequently, the location of the ports adjacent but also above tooth tips 19 ensures that contact of the tooth tips with a skin surface does not block the ports. It is also preferred that the orifices that comprise port means 35 be oriented such that a liquid stream exiting the orifices is directed both outwardly and downwardly to wet an area around and adjacent to the tooth tips. Manual operation of the pump 20 then delivers a metered squirt of liquid through conduit 28, into manifold 30, and out of tooth ports 35 to wet a defined area of skin around each tooth tip.

In use, the applicator device shown in FIG. 1 is pressed against the scalp or other hair covered surface much as one would use a brush. Tooth tips 19 are then in contact with the scalp thus positioning tooth ports 35 just above the scalp surface. Each metered squirt of liquid medicament then is placed directly upon the scalp surface with little or no wetting of the hair. After each application of the liquid the applicator 10 is moved to an adjacent untreated location until the desired area of the scalp surface has been wetted.

In some instances it is desirable that applicator 10, and in particular body member 12, be manufactured of a resilient material, suitably a plastic or rubber, so that it will deform sufficiently during use to allow teeth 18 to follow the natural contours of the scalp or other skin surface.

Figure 3:
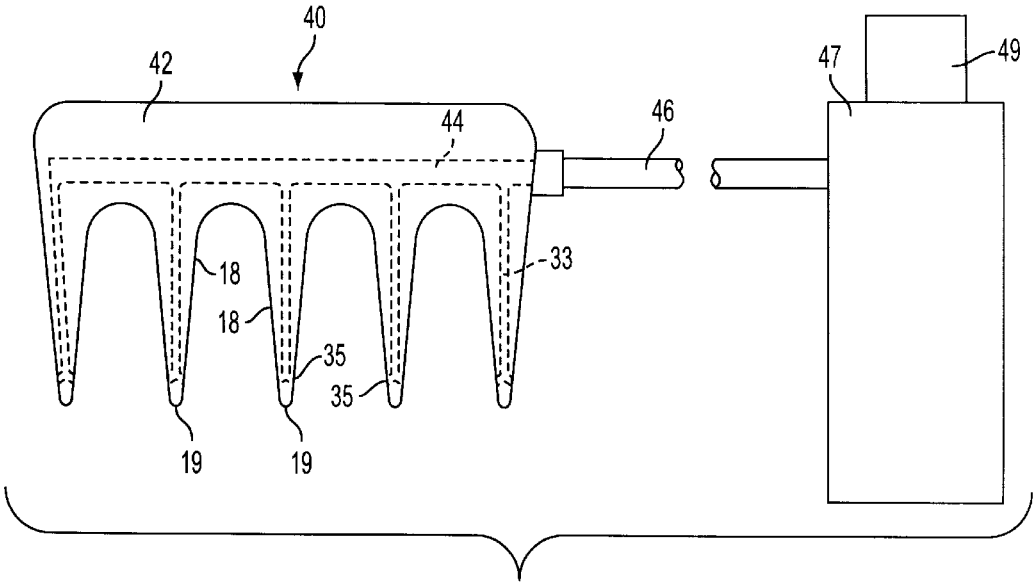
FIG. 3 is another embodiment of the applicator of FIG. 1.
Figure 4:
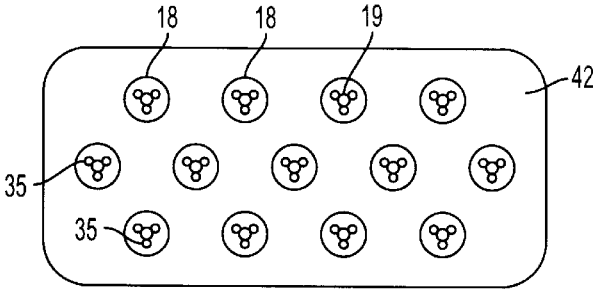
FIG. 4 is a bottom view of the applicator of FIG. 1 illustrating an arrangement of teeth on the applicator body.

FIG. 3 illustrates another embodiment 40 of the applicator of this invention. Applicator 40 includes a body portion 42 that is of a size and shape to be conveniently held in the hand. Body 40 is provided with a plurality of downwardly extending teeth 18 that may be identical to the teeth of applicator 10. Teeth 18 may be arranged in columns and row as is illustrated in FIG. 4. Each tooth 18 is provided with a longitudinally extending channel 33 connecting at its upper end to manifold 30 and terminating in one or more orifice ports 35 that are positioned just above the tooth tip 19. Each tooth channel 33 is arranged in fluid communication with a liquid distribution manifold 44 that, in turn, is attached through flexible conduit means 46 to a separate liquid reservoir 47. Reservoir 47 holds a quantity of a liquid medicament, and includes delivery means 49 for delivering metered pulses or squirts of liquid through conduit 46, manifold 44, channels 33, and out through ports 35. Delivery means 49 may be a hand operated pump similar to pump 20 of FIG. 1, or it may be a source of pressurizing gas much like that of an ordinary aerosol dispenser.

Applicator 40 is used in much the same manner as is applicator 10 of FIG. 1. The applicator is held in one hand and the applicator teeth are pressed against the scalp or other hair covered surface much as one would use a brush. That positions tooth ports 35 just above the scalp surface. Reservoir means 47 is held in the other hand, and delivery means 49 is then activated to deliver a metered squirt of liquid medicament from the reservoir and out through the tooth ports to wet the skin surface.

The applicator device of this invention has been described as being particularly useful in the routine application of a medicament such as minoxidil to the scalp of a human for the purpose of stimulating hair regrowth it may also find use for the application of medicaments to the hair-covered skin of an animal. For examples certain liquid preparations such as fipronil are used to provide flea and tick control for dogs and puppies. The formulation is typically packaged in a single-dose applicator having a tip similar to that of a dropper so that the tip can be worked through the hair to the skin surface at a location between the animal's shoulder blades. The liquid is then applied to that single spot while attempting to avoid wetting of the hair. The applicator described herein is especially advantageous to facilitate the application of liquids such as fipronil to the skin of animals having a heavy and thick coat, or long hair, or both.

Although the invention has been described and illustrated in terms of certain specific embodiments, various modifications and alterations to the structure and use of the applicator may be made without departing from the spirit and scope of the invention as defined by claims.

I claim:

1. Applicator means for delivering a liquid medicament to a hair-covered skin surface comprising:

an applicator having a plurality of teeth extending downwardly from said body, each said tooth having a longitudinally extending channel connecting at its upper end to a fluid manifold and terminating at its lower end in a port means, said prot means consisting of a least two orifices that are positioned adjacent to but above the tooth end, each said orifice positioned to direct a liquid stream exiting said orifice downwardly and outwardly to obtain wetting of a defined area of skin around each tooth end with little or no wetting of the hair around said tooth;

a reservoir for holding a supply of said liquid medicament; and means for delivering doses of liquid from said reservoir, through said manifold and tooth channels, and out through said port means.

2. The applicator means of claim 1 wherein said reservoir is contained within the applicator body.

3. The applicator means of claim 1 wherein said means for delivering doses of liquid comprises a manually operated metering pump.

4. The applicator means of claim 1 wherein said teeth are arranged in a plurality of rows and columns.

5. The applicator means of claim 1 wherein said reservoir is separate from said applicator body and is connected thereto through a flexible conduit.

6. The applicator means of claim 5 wherein said flexible conduit provides fluid communication between said reservoir and said fluid manifold.

7. The applicator means of claim 6 wherein the means for delivering doses of liquid comprises a manually operated metering pump.

8. The applicator means of claim 6 wherein the means for delivering doses of liquid comprises a source of pressurizing gas.

9. The applicator means of claim 1 wherein said body member is sufficiently deformable so as to allow said teeth to follow the natural contours of the skin surface.

* * * * *